US007561835B2

(12) United States Patent
Tanaka et al.

(10) Patent No.: US 7,561,835 B2
(45) Date of Patent: Jul. 14, 2009

(54) DEVELOPING DEVICE, AND IMAGE FORMING APPARATUS AND PROCESS CARTRIDGE USING THE DEVELOPING DEVICE

(75) Inventors: Shinya Tanaka, Ota-ku (JP); Masato Iio, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 470 days.

(21) Appl. No.: 11/411,031

(22) Filed: Apr. 26, 2006

(65) Prior Publication Data

US 2006/0239722 A1 Oct. 26, 2006

(30) Foreign Application Priority Data

Apr. 26, 2005 (JP) ..... 2005-127568
Apr. 27, 2005 (JP) ..... 2005-129373
Apr. 27, 2005 (JP) ..... 2005-129551

(51) Int. Cl.
*G03G 15/08* (2006.01)
*G03G 15/01* (2006.01)

(52) U.S. Cl. ..... 399/260; 399/224; 399/120

(58) Field of Classification Search ..... 399/58, 399/120, 224, 258, 260
See application file for complete search history.

(56) References Cited

U.S. PATENT DOCUMENTS 5,734,957 A 3/1998 Ogawa et al.
2003/0175051 A1* 9/2003 Sato et al. ..... 399/260
2004/0208674 A1 10/2004 Ilo et al.
2006/0008297 A1 1/2006 Oyama et al.

FOREIGN PATENT DOCUMENTS

JP 09-251233 9/1997
JP 2002-333764 11/2002
JP 2005-062215 3/2005

OTHER PUBLICATIONS

U.S. Appl. No. 11/666,750, filed May 2, 2007, Tanaka.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, P.C.

(57) ABSTRACT

A developing device including a developing unit configured to develop an electrostatic latent image with a toner; a toner cartridge configured to contain the toner and supply the toner to the developing unit, and including an agitator configured to agitate the toner, wherein the toner cartridge is detachably attached to the developing unit; at least one opening configured to pass the toner between the developing unit and the toner cartridge; and at least one control valve configured to open and shut the opening, wherein a toner replacement ratio (b/a) of the developing device satisfies relationship $0.05 \leqq b/a \leqq 2.0$, wherein a represents an amount of the toner supplied to the developing unit from the toner cartridge per a unit time and b represents an amount of the toner discharged to the toner cartridge from the developing unit per the unit time.

25 Claims, 11 Drawing Sheets

DEVELOPING DEVICE, AND IMAGE FORMING APPARATUS AND PROCESS CARTRIDGE USING THE DEVELOPING DEVICE

BACKGROUND OF THE INVENTION

1. Field of the Invention

The present invention relates to a developing device for developing an electrostatic image. More particularly, the present invention relates to a developing device for use in an electrophotographic image forming apparatus. In addition, the present invention also relates to an image forming apparatus and a process cartridge using the developing device.

2. Description of the Related Art

Recently, the development of office automation and colorization of documents have been remarkable. The need to print a document including figures (such as graphs made by a personal computer) by a printer and then copying the printed document to prepare materials for use in a presentation has been increasing, as well as the need to copy conventional full text documents. Because images produced by printers typically include solid images, line images and half tone images, printers are required to produce high quality solid, line and half tone images. In addition, printers are required to have high reliability.

In electrophotography, a developer is at once adhered to an electrostatic latent image formed on an image bearing member (e.g., a photoreceptor), and the resultant image is then transferred from the image bearing member onto a transfer medium such as a transfer paper, and finally fixed on the transfer paper. Specific examples of the developers configured to develop the electrostatic latent image formed on the image bearing member include two-component developers including a carrier and a toner and one-component developers consisting essentially of a toner (e.g., magnetic toner and non-magnetic toner). Two-component developers have the following drawbacks:

(1) Toner particles tend to adhere to the carrier, resulting in deterioration of charging property of the developer; and (2) Because only the toner is consumed in a developing process, a device for controlling the toner concentration of the developer is needed, resulting in upsizing of a developing device.

One-component developers have advantages over two-component developers such that the size of an image forming apparatus can be minimized and an image forming apparatus using one-component developers can be used under various temperature conditions and humidity conditions. Therefore, one-component developers have been mainly used recently.

One-component developers are broadly classified into two categories: magnetic one-component developers consisting of a magnetic toner and non-magnetic one-component developers consisting of a non-magnetic toner.

In magnetic one-component developing methods, a magnetic toner including a magnetic material (such as ferrite) is held on a developing sleeve, containing a magnetic field generating mechanism (such as magnets) therein, generating a magnetic field by the magnetic force thereof, and a thin toner layer is formed by a toner layer thickness control member for developing electrostatic latent images. Magnetic one-component developing methods are broadly used recently in compact printers.

In contrast, in non-magnetic one-component developing methods, a non-magnetic toner is fed on a developing sleeve by pressing a toner supply roller thereto. Thereby, the toner is held on the developing sleeve by the electric force, and a thin toner layer is formed by a toner layer thickness control member for developing electrostatic latent images.

Non-magnetic one-component developing methods are broadly used because of having the following advantages:

(1) Non-magnetic toners can be preferably used for full color machines because of including no magnetic material which is typically colored (i.e., because toners having good color reproducibility can be provided); and (2) The developing device can be miniaturized and the manufacturing cost thereof can be reduced because the developing sleeve includes no magnet.

However, one-component developing methods also have some drawbacks. In two-component developing methods, a carrier stably charges and transports a toner. In other words, a toner is transported to a developing sleeve to be developed after being sufficiently mixed with a carrier in a developing device. Therefore, the toner can be stably charged and transported even after a long repeated use. In addition, two-component developing methods can be easily applied to high-speed machines. In contrast, in one-component developing methods, there is no mechanism for stably charging and transporting a toner. Therefore, the toner cannot be stably charged and transported especially after a long repeated use, or when used in high-speed machines.

In particular, in non-magnetic one-component developing methods, a toner is transported to a developing sleeve and a thin toner layer is formed by a toner layer thickness control member, as mentioned above. In this case, a charging time in which the toner is contact-charged or friction-charged by frictional charging members (such as the developing sleeve and the toner layer thickness control member) is too short. Therefore, weakly or reversely charged toner particles are easily produced in one-component developing methods as compared with two-component developing methods.

As mentioned above, the toner is transported by the developing sleeve serving as a toner transport device to develop the electrostatic latent image formed on the image bearing member. Because the thickness of the toner held on the toner transport device is preferably as thin as possible, the toner is applied with a large pressure by the toner layer thickness control member. Therefore, external additive particles present on the surface of the toner particles are easily embedded therein, resulting in deterioration of chargeability and fluidity of the toner.

In attempting to solve these problems, published unexamined Japanese patent application No. (hereinafter referred to as JP-A) 08-122559 discloses an image forming apparatus including a magnet roller serving as a toner supply roller and a scraper serving as a toner layer thickness control member, both arranged in the vicinity of a toner supply opening formed between a toner supply tank and a toner hopper. The image forming apparatus further includes a toner supply roller driving device capable of rotating the toner supply roller in both forward and reverse directions. When the toner supply roller driving device rotates the toner supply roller, the following equation is satisfied:

$$A<B$$

wherein A represents a rotation angle of the toner supply roller in the forward direction in a predetermined time, and B represents a rotation angle of the toner supply roller in the reverse direction in the predetermined time. It is described in JP-A 08-122559 that by using such an image forming apparatus, deterioration of fluidity of the toner in the hopper can be prevented, and the toner can be constantly supplied to the developing roller.

JP-A 2005-062215 discloses a developing device including a developing sleeve having a conductive resin layer thereon. The conductive resin layer has the same polarity as that of a developer, and includes at least a binder resin, a particulate conductive material, and a charge controlling agent. It is described therein that by using this developing device, the toner cannot be excessively charged on the developing sleeve having such a conductive resin layer. In addition, the rotation center of an agitation member configured to agitate the developer is arranged under the horizontal plane including the rotation center of the developing sleeve. It is described in JP-A 2005-062215 that with such a configuration, the agitation member does not supply an excessive amount of toner to the developing sleeve, resulting in quick charging of the toner.

However, these techniques are insufficient to stabilize chargeability and fluidity of non-magnetic one-component developers in the developing device.

SUMMARY OF THE INVENTION

Accordingly, an object of the present invention is to provide a developing device that does not deteriorate chargeability and fluidity of a toner.

Another object of the present invention is to provide an image forming apparatus and a process cartridge that can produce high quality images for a long period of time.

These and other objects of the present invention, either individually or in combinations thereof, as hereinafter will become more readily apparent can be attained by a developing device, comprising:

a developing unit configured to develop an electrostatic latent image with a toner;

a toner cartridge configured to contain the toner and supply the toner to the developing unit, and comprising an agitator configured to agitate the toner, wherein the toner cartridge is detachably attached to the developing unit;

at least one opening configured to pass the toner between the developing unit and the toner cartridge; and at least one control valve configured to open and shut the opening, wherein a toner replacement ratio (b/a) of the developing device satisfies the following relationship:

$$0.05 \leqq b/a \leqq 2.0$$

wherein a represents an amount of the toner supplied to the developing unit from the toner cartridge per a unit time and b represents an amount of the toner discharged to the toner cartridge from the developing unit per the unit time; and an image forming apparatus and a process cartridge using the above developing device.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE PREFERRED EMBODIMENTS

A preferred embodiment of the developing device of the present invention will be explained in detail.

Figure 1:
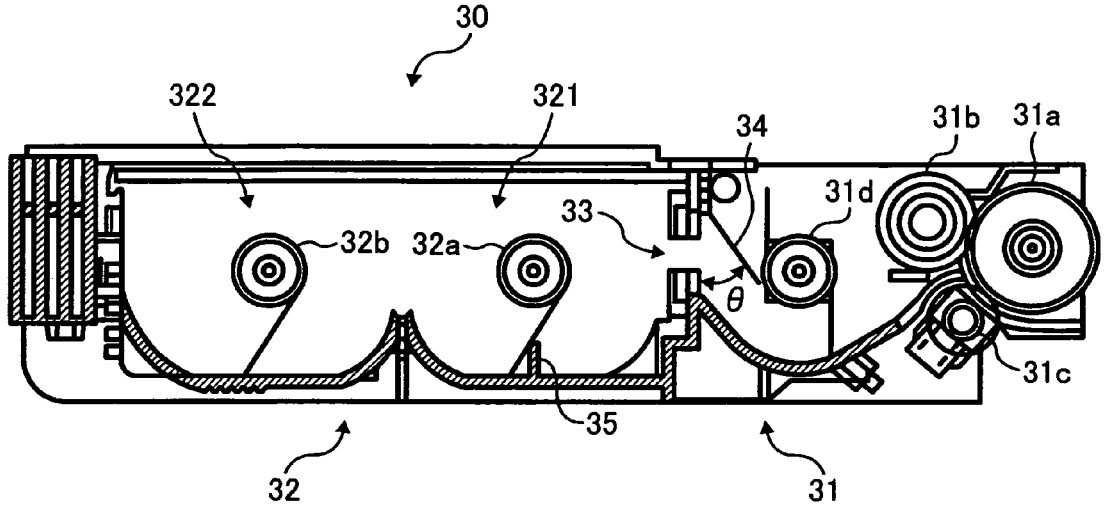
FIG. 1 is a schematic view illustrating an example of the developing device of the present invention.

FIG. 1 is a schematic view illustrating an embodiment of the developing device of the present invention.

A developing device 30 includes a developing unit 31 configured to develop an electrostatic image formed on a photoreceptor serving as an image bearing member with a toner serving as a developer, and a toner cartridge 32 configured to supply a toner to the developing unit 31.

The developing unit 31 faces the photoreceptor at a developing region, and includes a developing sleeve 31*a* configured to transport the toner to the developing region, a toner supply roller 31*b* configured to supply the toner to the developing sleeve 31*a*, a toner layer thickness control roller 31*c* (serving as a toner layer thickness control member) configured to control the thickness of the toner layer on the developing sleeve 31*a*, and a first transport paddle 31*d* serving as a rotation device configured to transport the toner.

The toner cartridge 32 includes a first toner storage room 321 and a second toner storage room 322 configured to store the toner, a second transport paddle 32*a* and a third transport paddle 32*b* serving as agitators configured to transport the toner to the developing unit 31, and a rib 35 serving as a projection arranged on the inner bottom surface of the first toner storage room 321 of the toner cartridge 32 at a portion in which the second transport paddle 32*a* rotates.

A one-component developer is used in the developing device 30. One-component developers have an advantage over two-component developers in terms of replacing the toner. In other words, when a two-component developer is used, it is hard to replace the toner in the two-component developer with a fresh toner. In contrast, when a one-component developer is used, it is easy to replace the developer with a fresh developer because the developer in the toner cartridge 32 is same as that in the developing unit 31. Therefore, a one-component developer is preferably used in the developing device 30 of the present invention. In particular, a non-magnetic one-component developer is preferably used. In non-magnetic one-component developers, chargeability and fluidity of the developers (i.e., toners) are largely influenced by conditions of external additives present on the surface of the developers. In contrast, in magnetic one-component developers, developability of the developers is influenced by a magnetic force depending on the amount of a magnetic material included therein. By using a non-magnetic one-component developer for the developing device 30 of the present invention, the developer can maintain good developability for a long period of time because the external additive present on the surface of the developer can be maintained without problems such as releasing and embedding of the external additives.

In the developing device 30, the developing unit 31 and the toner cartridge 32 are arranged in line on the horizontal direction. One or more openings 33 are formed between the developing device 31 and the toner cartridge 32 to transport the toner therebetween. A control valve 34 is arranged so as to face the openings 33 on the side of the developing unit 31.

In the developing device 30, the toner passes through the openings 33. Thereby, a toner of a same amount as that of a toner consumed in the developing unit 31 is transported from the toner cartridge 32 to the developing unit 31 through the openings 33 to replenish the toner, and the toner in the developing unit 31, which is deteriorated because of being repeatedly used, is returned and discharged (hereinafter referred to as discharged) from the developing unit 31 to the toner cartridge 32 to be mixed with a fresh toner. The toner cartridge 32 can be replaced with a new one independently of the developing unit 31.

The toner from the developing unit 31 is under a pressure from the toner supply roller 31*b* and the toner layer thickness control roller 31*c*. Thereby, concavities and convexities formed on the surface of the toner are smoothened, and therefore an adhesiveness of the toner to the photoreceptor increases. Such toner, however, is more difficult to clean. In other words, such toner remaining on the photoreceptor is more difficult to be removed therefrom. Especially under low humidity, such toner may not be sufficiently removed from the photoreceptor. On the other hand, such toner has high transferability. For these reasons, images produced by such toner may have fog in an image background. Typically, fog is hardly visually observed even if a toner is transferred on an image background.

In addition, external additive particles present on the surface of toner particles tend to be embedded therein by receiving a pressure, because the external additive is typically harder than the toner. As the amount of the external additive particles present on the surface of the toner particles decreases, chargeability of the toner changes. In particular, silica, for use as an external additive, has high charge quantity because of having a large specific surface area. Therefore, as the amount of the silica present on the surface of the toner particles decreases, chargeability of the toner largely changes.

Moreover, fluidity of the toner decreases as the external additive particles are embedded in the toner particles. The fluidity represents adhesiveness of the toner. For example, the external additive can decrease an adhesiveness between the toner and the photoreceptor by existing therebetween. Similarly, the external additive can decrease an adhesiveness between the toner and the developing sleeve 31 by existing therebetween, resulting in improvement of developability of the toner. As the amount of the external additive particles present on the surface of the toner particles decreases, developability of the toner decreases.

In the developing device 30 of the present invention, toner particles remaining in the developing unit 31 are at once returned and discharged to the toner cartridge 32 through the openings 33. Thereby, the toner particles in the developing unit 31 are mixed with fresh toner particles in the toner cartridge 32 to decrease the content of deteriorated toner particles, and then the thus mixed toner particles are transported to the developing unit 31 again through the openings 33.

Figure 2:
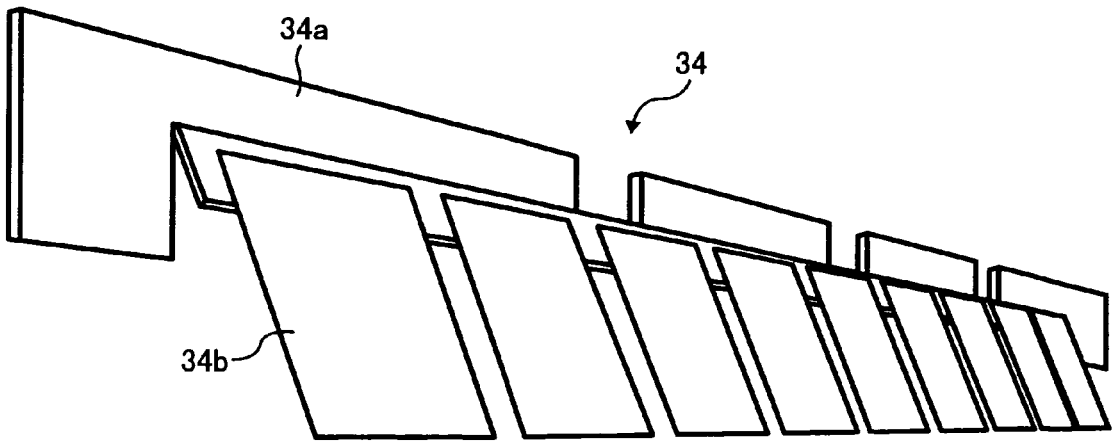
FIG. 2 is a schematic view illustrating an example of a control valve for use in the developing device illustrated in FIG. 1.

FIG. 2 is a schematic view illustrating an example of the control valve 34 for use in the developing device 30 of the present invention. The control valve 34 is fixed to a housing of the developing unit 31 so as to face the openings 33. Films 34*b* served as motion parts are attached to a support part 34*a*. Each of the films 34*b* of the control valve 34 is arranged so as to face each of the openings 33, and has a rectangular shape, but the shape is not particularly limited. At portions in which the openings 33 do not exist, the film 34*b* is not arranged in general.

The support part 34*a* is made of a rigid metal such as SUS, Cu and Al. The films 34*b* are made of an elastic resin such as polypropylene resins, polyethylene resins, polyester resins and fluorocarbon resins.

The first transport paddle 31*d* of the developing unit 31 includes one or more paddle films, serving as a rotation member. The first transport paddle 31*d* rotates to transport a toner, which is transported from the toner cartridge 32, to the developing sleeve 31*a*. The form of the films 34*b* of the first transport paddle 31*d* is not particularly limited. For example, the film may be a single film (or plate) having rectangular form, a single film (or plate) in which the portions facing the films 34*b* have a rectangular form, films facing the films of the film 34*b* or combination thereof or the like.

FIGS. 3A-3D are schematic views for explaining how the toner in the toner cartridge 32 is transported to the developing unit 31.

Figure 3A:
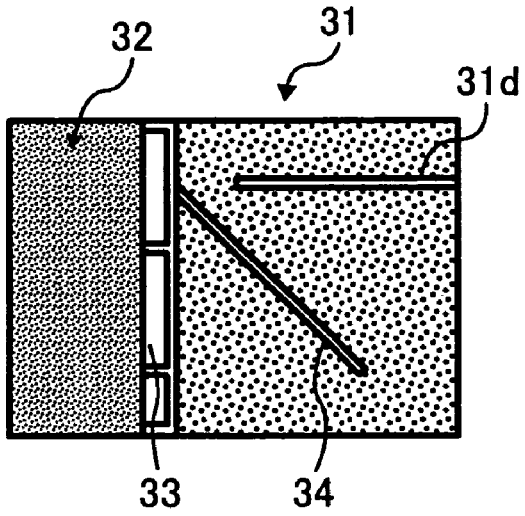
FIGS. 3A-3D are schematic views for explaining how the toner in the toner cartridge is transported to the developing unit.
Figure 3B:
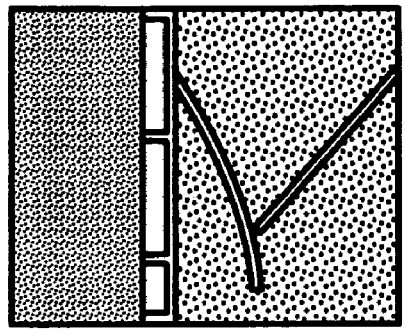
Figure 3C:
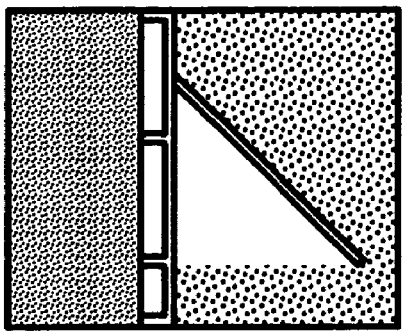
Figure 3D:
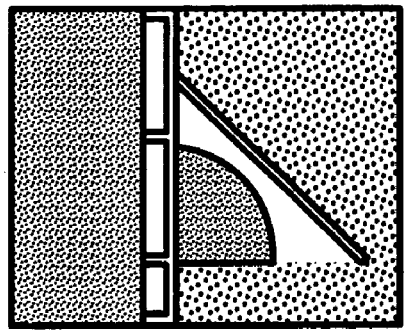

As illustrated in FIGS. 3A-3B, when the film of the first transport paddle 31*d* (hereinafter referred to as the first transport paddle 31*d*) hits the film of the control valve 34 (hereinafter referred to as the control valve 34), the control valve 34 is bent by the pressure of the first transport paddle 31*d*. When the control valve 34 is released from the first transport paddle 31*d*, the control valve 34 quickly springs up due to its elasticity, and a space is formed on the downstream side from the control valve 34 relative to the rotation direction thereof as illustrated in FIG. 3C. The toner in the toner cartridge 32, which is pressed by the second transport paddle 32*a* toward the openings 33, enters into the space formed in the developing unit 31 as illustrated in FIG. 3D. Thus, the toner is transported from the toner cartridge 32 to the developing unit 31 through the openings 33.

Figure 4A:
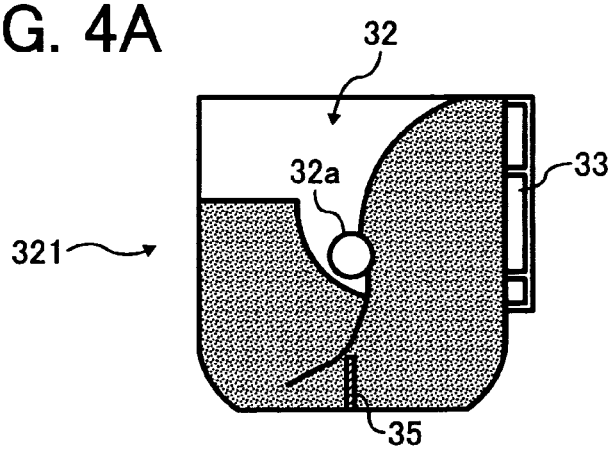
FIGS. 4A-4C are schematic views for explaining how the toner in the toner cartridge is agitated and transported by a rotation member.
Figure 4B:
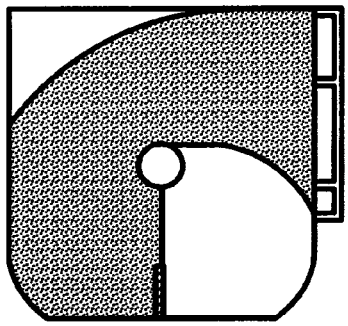
Figure 4C:
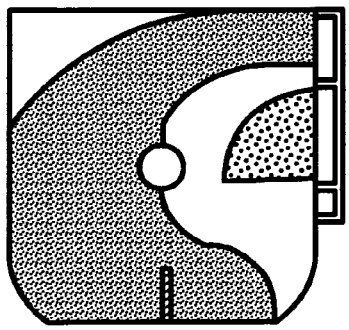

FIGS. 4A-4C are schematic views for explaining how the toner particles in the toner cartridge 32 are moved by the second transport paddle 32*a*. Referring to FIGS. 1 and 3A-3D, in the toner cartridge 32, the third transport paddle 32*b* in the second toner storage room 322 transports toner particles to the first toner storage room 321. The second transport paddle 32*a* transports the thus transported toner particles toward the developing unit 31. The second transport paddle 32*a* includes one paddle film having elasticity (i.e., a bendable film). The toner particles in the first toner storage room 321 are fed toward the developing unit 31 by rotating the paddle film of the second transport paddle 32*a*. In addition, the rib 35 is arranged on the inner bottom surface of the first toner storage room 321. When the paddle film of the second transport paddle 32*a* is located at such a position as to be contacted with the rib 35 and then is released from the rib 35 while bending as illustrated in FIG. 4A to FIG. 4B, a space is formed between the paddle film and the rib 35 on the downstream side from the paddle film relative to the rotation direction thereof. This phenomenon is caused by synergistic action between blocking of the toner particles by the combination of the rib and the paddle film and quick movement of the paddle film. The space is gradually filled with a toner having high fluidity, however, the space is maintained for a while. By rotation of the paddle film, toner particles also come into the space from the upper side thereof, and the space disappears.

When a timing such that the paddle film pushes the toner particles into the developing unit 31 corresponds with a timing such that the control valve 34 of the developing unit 31 is opened and not pressed by the paddle film of the first transport paddle 31*d* (i.e., the control valve is in a home position), the toner particles are supplied from the toner cartridge 32 to the developing unit 31 through the openings 33.

When the control valve 34 is opened, toner particles come into an area below the control valve 34. When a timing such that (1) the paddle film of the first transport paddle 31*d* presses the control valve 34 to push the toner particles present below the control valve 34 into the toner cartridge 32 from the developing unit 31 corresponds with a timing such that (2) a space formed by the paddle film of the second transport paddle 32*a* in the first toner storage room 321 is located in the vicinity of the openings 33, the toner particles in the developing unit 31 are discharged to the toner cartridge 32 through the openings 33.

Movements of the first, second, and third transport paddles 31*d*, 32*a*, and 32*b* and the toner in the developing device 30 will be explained in detail.

Figure 5A:
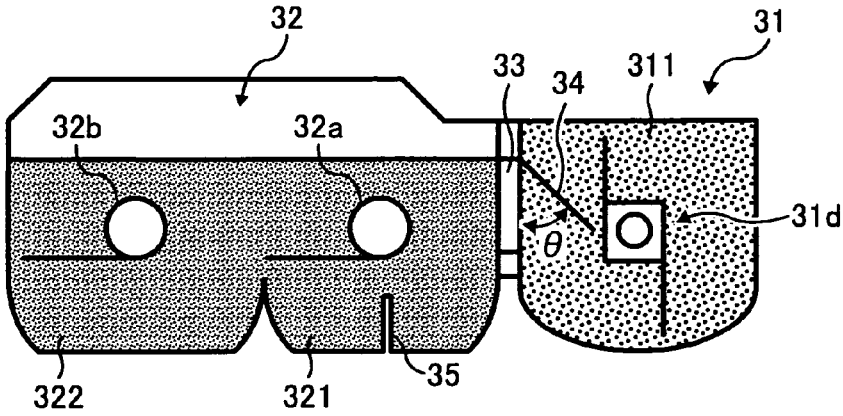
FIGS. 5A-5P are schematic views for explaining how the toner in the toner cartridge and the developing unit are mixed.
Figure 5B:
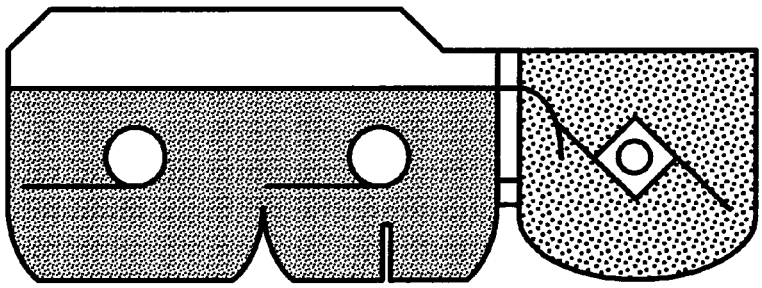
Figure 5C:
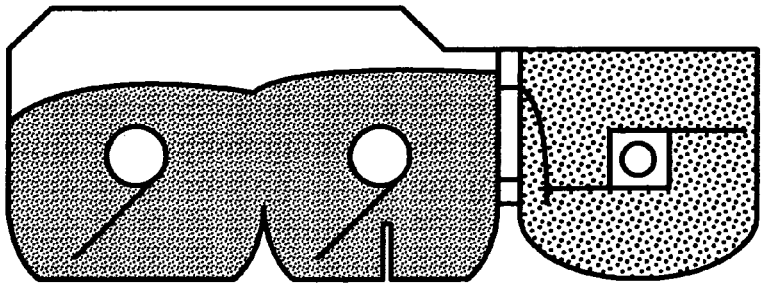
Figure 5D:
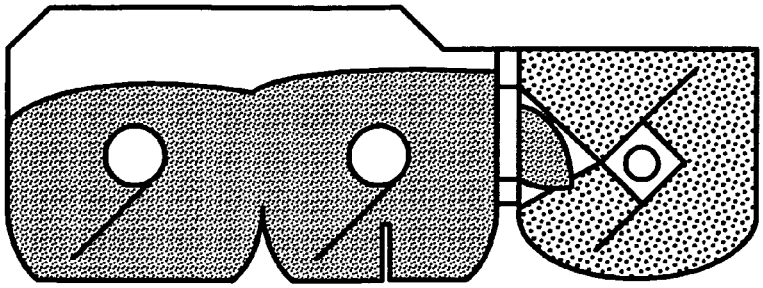
Figure 5E:
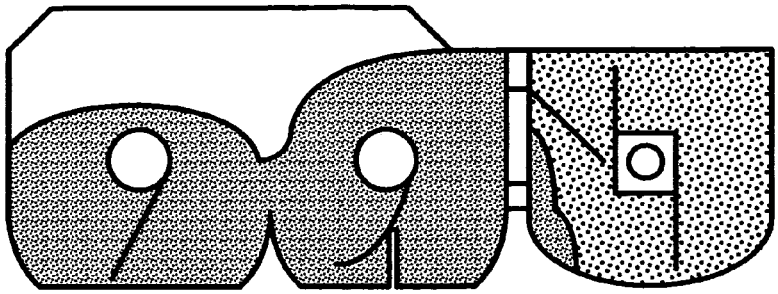
Figure 5F:
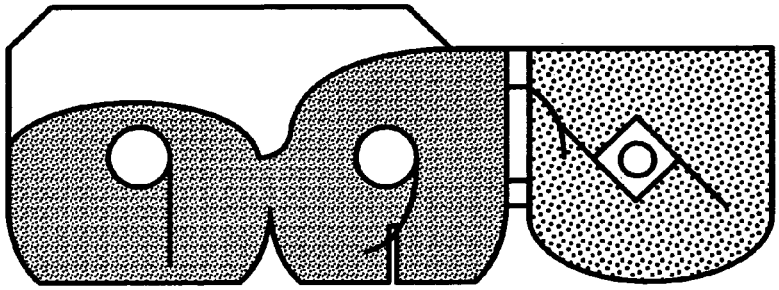
Figure 5G:
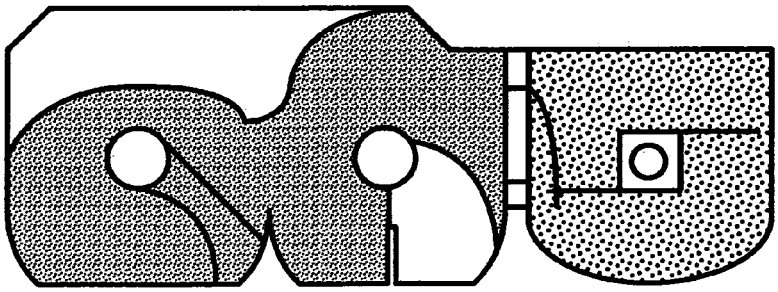
Figure 5H:
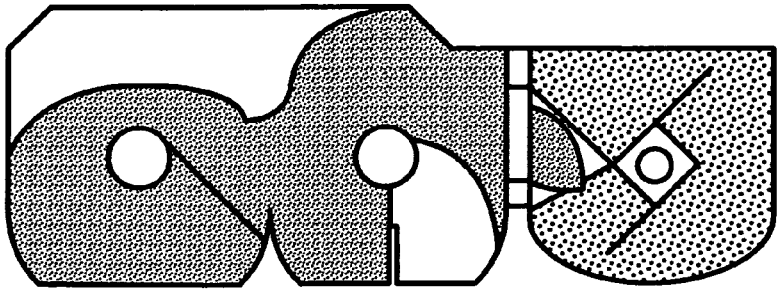
Figure 5I:
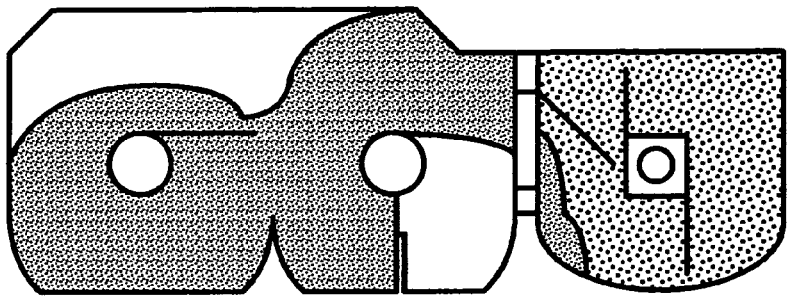
Figure 5J:
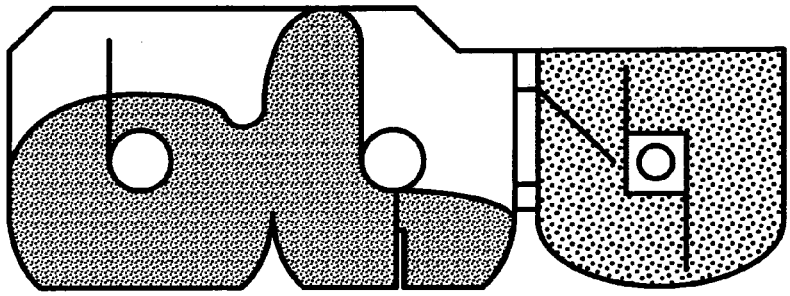
Figure 5K:
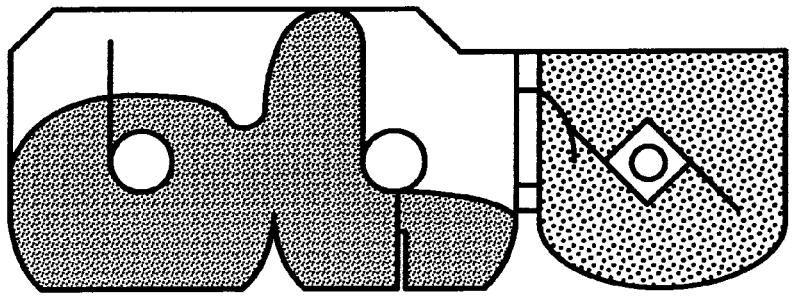
Figure 5L:
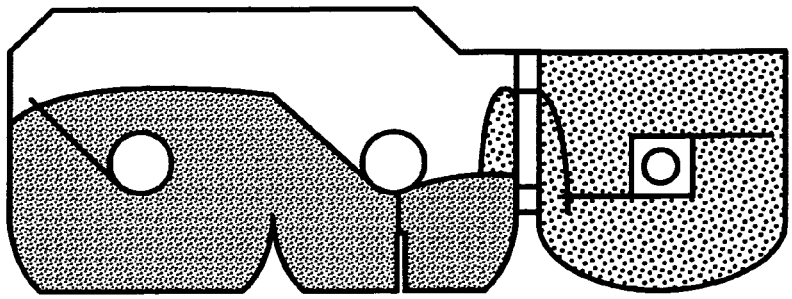
Figure 5M:
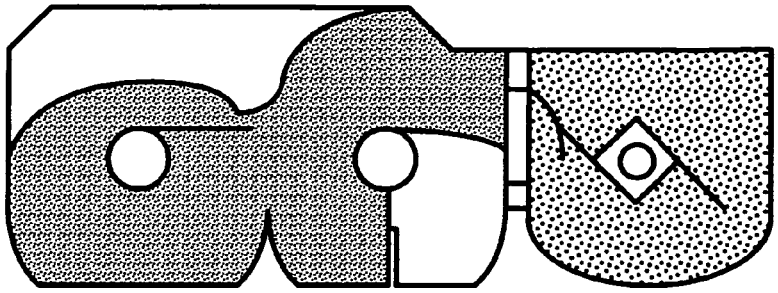
Figure 5N:
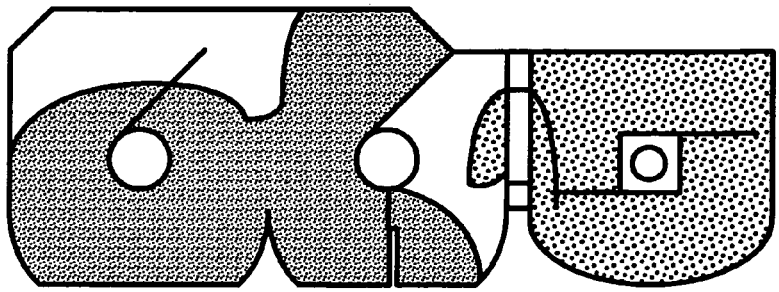
Figure 5O:
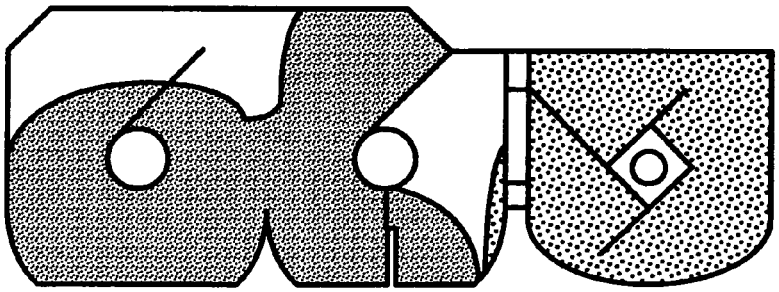
Figure 5P:
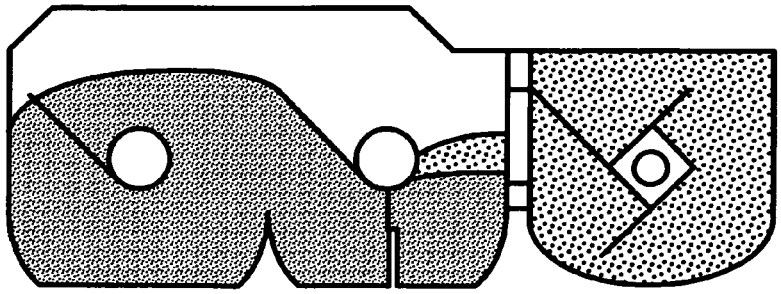

FIGS. 5A-5P are schematic views for explaining how the toner is moved between the developing unit 31 and the toner cartridge 32. In FIGS. 5A-5P, the developing sleeve 31*a*, the toner supply roller, and the toner layer thickness control roller, etc. are omitted.

As illustrated in FIG. 5A, the control valve 34 and a surface in which the openings 33 are arranged form an angle of θ. The first transport paddle 31 d rotates plural (for example, two) paddle films. The second and third transport paddles 32*a* and 32*b* of the toner cartridge 32 respectively rotates one paddle film.

As illustrated in FIG. 5B, the plural paddle films of the first transport paddle 31*d* press the control valve 34, thereby pressing the toner particles present between the control valve 34 and the openings 33. Since the first toner storage room 321 is filled with the toner, the toner particles cannot be discharged to the first toner storage room 321 and thereby the toner particles move laterally and return to the developing unit 31.

As illustrated in FIG. 5C, the control valve 34 is further pressed by the paddle films of the first transport paddle 31*d* so as to be close to the openings 33 (i.e., the control valve 34 is in a working position).

As illustrated in FIGS. 5D and 5E, when the control valve 34 is released from the paddle films of the first transport paddle 31*d*, the control valve 34 returns to the home position, resulting in formation of a space between the control valve 34 and the openings 33. Thereby, the toner in the first toner storage room 321 is supplied to the developing unit 31 through the openings 33.

As illustrated in FIG. 5F, the paddle films of the first transport paddle 31*d* press again the control valve 34. On the other hand, in the first toner containing room 321 of the toner cartridge 32, the paddle film of the second transport paddle 32*a* is in contact with the rib 35.

As illustrated in FIG. 5G, the plural paddle films of the first transport paddle 31*d* further press the control valve 34 so that the control valve 34 is close to the openings 33. On the other hand, the paddle film of the second transport paddle 32*a* is further rotated so as to be released from the rib 35, and thereby a space is formed between the paddle film of paddle 32*a* and the rib 35 on the downstream side from the paddle film relative to the rotation direction thereof.

The second transport paddle 32*a* preferably includes a convex member having a fan shape in cross section arranged on the downstream side from its paddle film relative to the rotation direction thereof. The convex member and the paddle film form an angle of from 30 to 120°. A combination of the convex member and the rib 35 can prevent the toner from moving into the space which is formed by rotation of the paddle film, and therefore the space can be stably maintained for a while. When the angle is too small, it is insufficient to prevent the toner from moving into the space. When the angle is too large, the space exists for too long a time, resulting in insufficient supply and transport of the toner.

As illustrated in FIGS. 5H and 5I, the paddle films of the first transport paddle 31*d* are released from the control valve 34, and thereby the control valve 34 returns to the home position, resulting in formation of a space between the control valve 34 and the openings 33. Thereby, the toner particles pressed by the paddle film of the second transport paddle 32*a* in the first toner storage room 321 are supplied to the developing unit 31 through the openings 33.

It is preferable that a distance between a side end of the paddle film of the second transport paddle 32*a* and an inner side wall of the toner cartridge, which faces the side end of the paddle film, is not larger than 20 mm. When the distance is too large, a large dead space is formed, resulting in deterioration of efficiencies of toner agitation and toner transport.

As illustrated in FIGS. 5J-5L, another paddle film of the first transport paddle 31*d* presses the control valve 34. In this case, a space is formed in the vicinity of the openings 33 in the first toner storage room 321. Thereby, the toner particles between the control valve 34 and the openings 33 are discharged from the developing unit 31 to the toner cartridge 32 through the openings 33.

As illustrated in FIGS. 5M-5P, when the rotation speed of the first transport paddle 31*d* is faster than that of the second transport paddle 32*a*, the toner in the developing unit 31 can be well discharged from the developing unit 31 to the toner cartridge 32.

The control valve 34 performs at least one shutting and opening operation while a space is formed in the toner cartridge 32. In addition, the control valve 34 performs at least one shutting and opening operation after the space disappears from the toner cartridge 32.

By repeating these operations, the toner can be transported between the developing unit 31 and the toner cartridge 32 through the openings 33.

The amount of toner particles supplied to the developing unit 31 and the amount of toner particles discharged to the toner cartridge 32 can be controlled by changing the rotation speeds of the first transport paddle 31*d* of the developing unit 31 and the second transport paddle 32*a* of the toner cartridge 32.

The rotation speed (R1) of the first transport paddle 31*d* of the developing unit 31 and the rotation speed (R2) of the second transport paddle 32*a* of the toner cartridge 32 preferably have the following relationship:

$$1/10 \leq R2/R1 \leq 4/1.$$

Thereby, the amount of toner particles supplied to the toner cartridge 31 per a unit time (a) and the amount of toner particles discharged to the toner cartridge 32 per the unit time (b) can be controlled to satisfy the following equation:

$$0.05 \leqq b/a \leqq 2.0$$

When b/a is too small, occurrence of background fouling cannot be sufficiently prevented. When b/a is too large, the amount of discharged toner particles is too large, resulting in unstable developing operation.

For example, the rotation speed (R1) of the first transport paddle 31*d* can be set to from 0.5 to 5.0 revolutions/second, and the rotation speed (R2) of the second transport paddle 32*a* can be set to from 0.04 to 0.4 revolutions/second. By setting each of the rotation speeds in the above-mentioned ranges, the amount of toner particles supplied to the toner cartridge 31 per a unit time (a) and the amount of toner particles discharged to the toner cartridge 32 per the unit time (b) can be controlled to satisfy the following equation:

$$0.05 \leqq b/a \leqq 2.0$$

When each of the rotation speeds is set outside of the above-mentioned ranges, b/a cannot be controlled as easily.

In the present invention, it is more preferable that b/a is from 0.05 to 0.95. Thereby, developing operations can be stably performed for a long period of time because an appropriate amount of the toner can be stably supplied to the developing unit 31. When b/a is too small, occurrence of background fouling cannot be sufficiently prevented. When b/a is too large, the amount of supplied toner particles decreases.

In addition, the amount of supplied toner particles and discharged toner particles can be controlled by changing the number of the openings 33. Therefore, the number of the openings 33 is not less than 1. The number of the openings 33 is preferably determined depending on the image forming speed of the image forming apparatus for which the developing device is used.

The control valve 34 is arranged so as to face the openings 33, and has a comb shape as illustrated in FIG. 2, for example. Adjoining films 34*b* of the control valve 34 can be operated alternately, if each of the paddle films of the first transport paddle 31*d* has a comb shape such that each of the projections is arranged so as to face the alternate films 34*b* of the control valve 34. By using two of such paddle films, all the films 34*b* of the control valve 34 can be operated alternately. By operating the films 34*b* of the control valve 34 alternately, dead spaces cannot be formed in the developing unit 31, and the toner can be uniformly discharged.

The films 34*b* of the control valve 34 are not greater than 20 mm wider than each of the openings 33. When the film 34*b* is narrower than each of the openings 33, the openings 33 are filled with the toner in the developing unit 31 and the toner cannot be sufficiently supplied to the developing unit 31. In addition, too large an amount of the toner is discharged from the developing unit 31, and therefore the amount of the toner in the developing unit 31 decreases.

When the toner is discharged, the first transport paddle 31*d* presses toner particles between the control valve 34 and the openings 33 which are moved in from both sides of the control valve 34. Therefore, when the films 34*b* of the control valve 34 are too much wider than the opening 33, the amount of toner particles moved into an area formed between the control valve 34 and the openings 33 decreases, resulting in decrease of the toner replacement. On the other hand, toner particles supplied from the toner cartridge 32 through the openings 33 move to the lower side of the developing unit 31 and mix with toner particles present below the control valve 34. Therefore, when the films 34*b* of the control valve 34 are too much wider than the opening 33, the amount of supplied toner particles decreases, and thereby the toner particles cannot be mixed homogeneously.

For these reasons, the films 34*b* of the control valve 34 are not greater than 20 mm wider than each of the openings 33. Thereby, the amount of supplied and discharged toner particles can be easily controlled, and the toner particles can be homogenously mixed.

A distance between each of the films 34*b* of the control valve 34 is from 2 to 20 mm. When the distance is too small, the amount of toner particles moved into an area formed between the control valve 34 and the openings 33 decreases, and therefore the amount of discharged toner particles decreases. When the distance is too large, the number of the openings 33 which can be arranged decreases, and therefore the amount of supplied and discharged toner particles decreases.

The films 34*b* of the control valve 34 have a length of from 10 to 25 mm. The size of a space which can be formed between the control valve 34 and the opening 33 is determined depending on the length of the films 34*b*. When the length is too short, the amount of discharged toner particles decreases, resulting in insufficient toner replacement. When the length is too long, the amount of discharged toner particles increases, and therefore the amount of toner particles in the developing unit 31 decreases.

The control valve 34 forms an angle θ against the surface of the developing unit in which the openings 33 are arranged of from 20° to 45° at a home position, and of from 0° to 15° at a working position. Since the control valve 34 tends to bend because of its elasticity, the angle θ is defined as an angle formed between (1) a line joining a contact point of the control valve 34 and the surface of the developing unit in which the openings 33 are arranged, and a tip of the control valve 34, and (2) the surface of the developing unit in which the openings 33 are arranged. The size of a space formed between the control valve 34 and the opening 33 is determined depending on the angle θ. When the angle θ at the home position is too small, the amount of discharged toner particles decreases, and therefore the toner cannot be sufficiently replaced. When the angle θ at the home position is too large, the amount of discharged toner particles increases, and therefore the amount of toner particles in the developing unit 31 decreases.

It is preferable that the developing device of the present invention further includes an equalizer configured to equalize the toner replacement ratio b/a for each of the plural openings.

Figure 6:
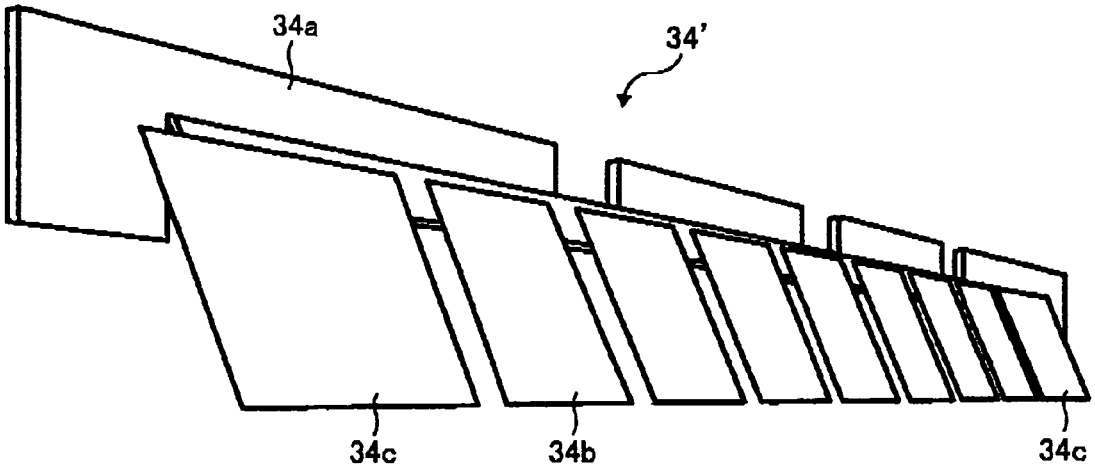
FIG. 6 is a schematic view illustrating another example of the control valve for use in the developing device illustrated in FIG. 1.

A first example of an equalizer is illustrated in FIG. 6. FIG. 6 is a schematic view illustrating an example of a modified control valve 34' that can be used in the present invention. In this case, films 34*c* arranged on the both ends of the control valve 34 in a longitudinal direction are not less than 20% wider than the other films 34*b*. Thereby, the amount of toner particles moved to the backside of the films 34*c*, and the amount of toner particles moved to the backside of the films 34*b* can be almost equalized, resulting in equalizing the toner replacement ratio b/a for each of the plural openings 33. When the films 34*c* are less than 20% wider than the other films 34*b*, the amount of toner particles moved to the backside of the films 34*c* cannot be sufficiently controlled. It is preferable that the films 34*c* are not greater than 50% wider than the other films 34*b*, but is not limited thereto. When the films 34*c* are greater than 50% wider than the other films 34*b*, operability of the control valve 34 deteriorates.

Figure 7:
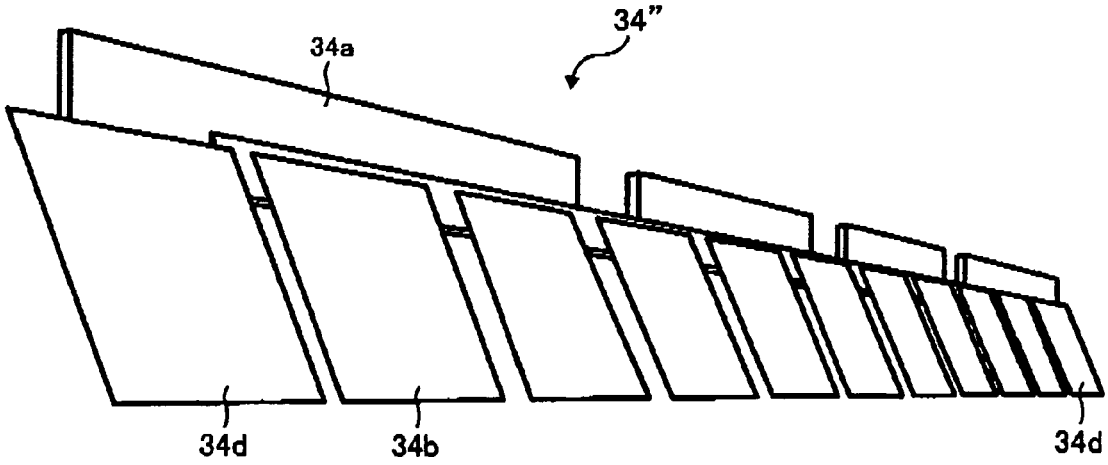
FIG. 7 is a schematic view illustrating another example of the control valve for use in the developing device illustrated in FIG. 1.

A second example of an equalizer is illustrated in FIG. 7. FIG. 7 is a schematic view illustrating an example of another modified control valve 34" that can be used in the present invention. In this case, films 34*d* having the same configuration as the films 34*b* are arranged on an outside of each of both end films 34*b*. In other words, the films 34*d* are arranged on portions in which no opening is arranged. Thereby, movement of the toner around the films 34*b* and the films 34*d* can be almost equalized, resulting in equalizing the toner replacement ratio b/a for each of the plural openings.

Figure 8:
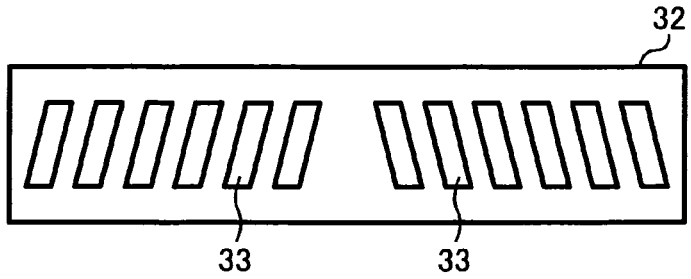
FIG. 8 is an elevation view illustrating an example of the openings for use in the developing device illustrated in FIG. 1.

A third example of an equalizer is illustrated in FIG. 8. FIG. 8 is an elevation view of an example of the openings 33 that can be implemented in the present invention. The openings 33 have a configuration such that openings having a same shape and same number are laterally symmetrically arranged. Thereby, the toner can more uniformly move between the developing unit and the toner cartridge.

On the other hand, b/a for each of the plural openings can be changed to make a large toner flow in the developing device of the present invention.

To effectively replace the toner between the developing unit 31 and the toner cartridge 32, a toner flow such that the toner passes through the openings 33 has to be made. Such toner flow can be made when the toner replacement ratios b/a for the plural openings 33 are different from each other. As mentioned above, the toner replacement ratio is defined as follows:

$$b/a$$

wherein a represents the amount of toner particles supplied from the toner cartridge 32 to the developing unit 31 per a unit time, and b represents the amount of toner particles discharged from the developing unit 31 to the toner cartridge 32 per the unit time. When b/a is less than 1, it means the amount of toner particles supplied from the toner cartridge 32 to the developing unit 31 is larger than the amount of toner particles discharged from the developing unit 31 to the toner cartridge 32. When b/a for the plural openings 33 are different from each other, the toner flow can be made along a longitudinal direction of the developing unit 31 and the toner cartridge 32. Thereby, toner particles that once come into the developing unit 31 will not return to the toner cartridge 32, resulting in improvement of the toner circularity.

In particular, when b/a for a central opening is lower than b/a for an end opening thereof, the toner flow can be enlarged. When b/a is less than 1, the toner tends to move to the developing unit 31. In contrast, when b/a is larger than 1, the toner tends to move to the toner cartridge 32. Therefore, when b/a for the central opening is less than 1 and b/a for the end opening is larger than 1, a large toner flow can be made such that the toner moves to the developing unit 31 in the central portion and the toner moves to the toner cartridge 32 in the end portions, while all of the openings pass the toner.

Figure 9:
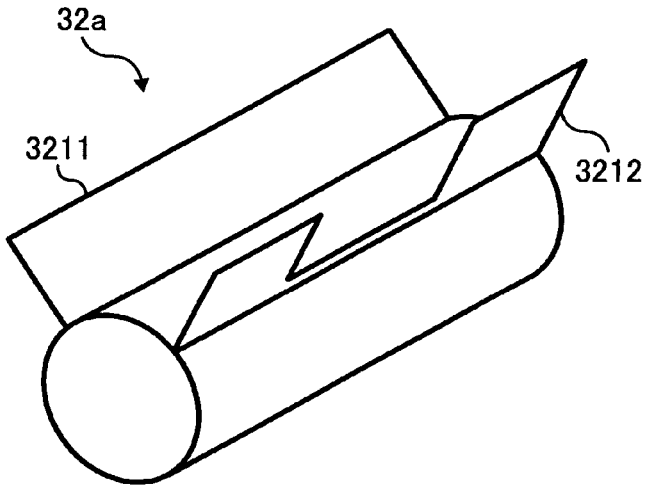
FIG. 9 is a schematic view illustrating an example of the toner transport paddle in the toner cartridge.

FIG. 9 is a schematic view illustrating an example of the second transport paddle 32*a* of the toner cartridge 32. As mentioned above, the second transport paddle 32 includes an elastic paddle film 3211, configured to form a space in the toner cartridge. When b/a for the plural openings are different from each other so as to make a big toner flow, the second transport paddle 32*a* preferably includes a platy member 3212 located on both end portions of the second transport paddle 32*a* and arranged on the downstream side from the paddle film 3211 relative to the rotation direction thereof. The elastic paddle film 3211 and the platy member 3212 form an angle of from 30 to 120°. By arranging such a platy member 3212, a much larger space can be formed in the toner cartridge. However, because the platy member 3212 is not arranged in the central portion, a space formed in the central portion is much smaller. When the angle is too small, the platy member 3212 cannot contribute to forming the space. When the angle is too large, the elastic paddle film 3211 cannot sufficiently form the space.

Figure 10:
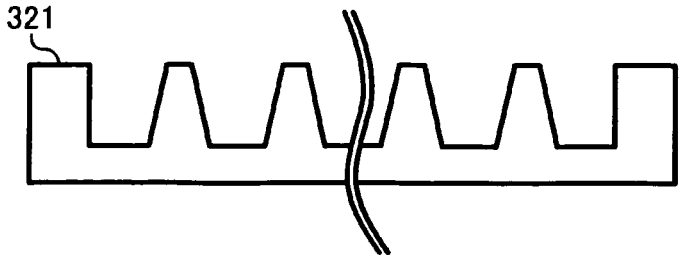
FIG. 10 is a schematic view illustrating an example of the paddle film of the toner transport paddle in the developing unit.

FIG. 10 is a schematic view illustrating an example of the paddle film 321 of the first transport paddle 31*d*. As mentioned above, the paddle film 321 can have a comb shape in which projections are arranged so as to face the films of the control valve 34. In addition, projections are also formed on the both ends of the paddle film 321. These both end projections do not face the films of the control valve 34, and therefore these both end projections do not work for operating the control valve 34. When the control valve 34 does not operate, these both end projections work for transporting toner particles present outside of both end openings in a longitudinal direction to a vicinity of the openings 33. By agitating the toner particles present outside of both end openings, any such stagnating toner can be circulated.

Figure 11:
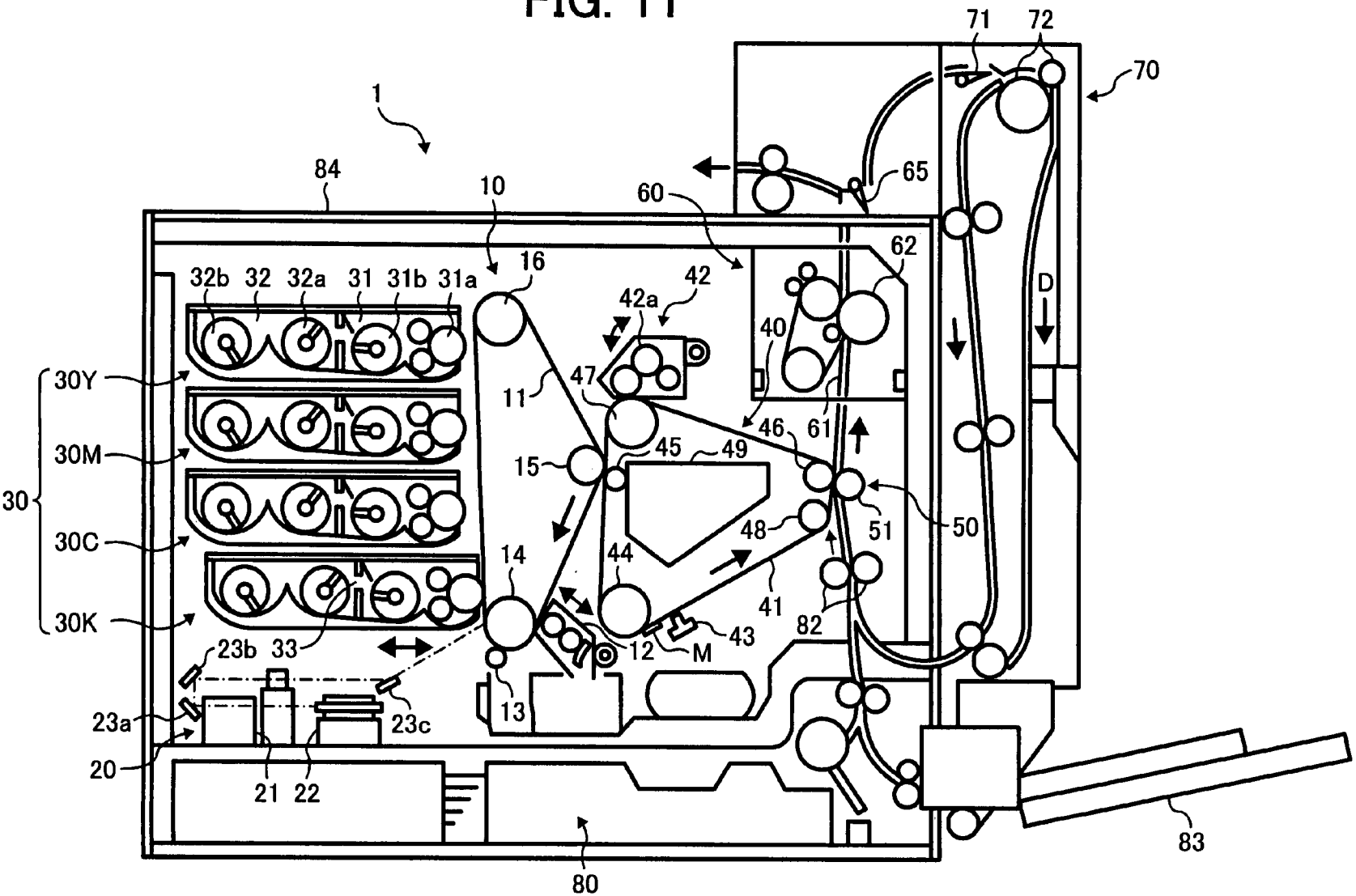
FIG. 11 is a schematic view illustrating an example of the image forming apparatus of the present invention.

FIG. 11 is a schematic view illustrating an embodiment of an image forming apparatus including the developing device of the present invention.

An image forming apparatus 1 includes a photoreceptor unit 10, a writing optical unit 20, a developing unit 30 including developing devices 30K, 30C, 30M and 30Y (having the same configuration as the developing device illustrated in FIG. 1), an intermediate transfer unit 40, a secondary transfer unit 50, a fixing unit 60, a duplex printing paper reversing unit 70, a paper cassette 80, and other elements discussed below. A black toner image, a cyan toner image, a magenta toner image, and a yellow toner image are formed one by one on a photoreceptor belt 11 of the photoreceptor unit 10, and these images are finally superimposed so as to produce a full color image. Around the photoreceptor belt 11, a photoreceptor cleaning device 12, a charging roller 13, the developing devices 30Y, 30M, 30C and 30K, and an intermediate transfer belt 41 of the intermediate transfer unit 40 are arranged. The photoreceptor belt 11 is stretched by a driving roller 14, a primary transfer facing roller 15, and a stretching roller 16, and is rotated by a driving motor (not shown). The writing optical unit 20 converts color image data into optical signals, and performs writing based on color information, resulting in formation of an electrostatic latent image on the photoreceptor belt 11. The writing optical unit 20 includes a semiconductor laser 21 serving as a light source, a polygon mirror 22, and reflective mirrors 23*a*, 23*b*, and 23*c*.

A black developing device 30K containing a black toner, a cyan developing device 30C containing a cyan toner, a magenta developing device 30M containing a magenta toner, and a yellow developing device 30Y containing a yellow toner, are arranged in the image forming apparatus 1 in this order from the lower side thereof. Further, an attach/detach mechanism (not shown) configured to move each of the developing devices 30K-30Y toward or away from the developing belt 11 is arranged in the image forming apparatus 1.

The toner contained in each of the developing devices 30 (symbols K, C, M and Y representing each of the colors are omitted) is charged to a predetermined polarity. A developing bias is applied to the developing sleeve 31*a* by a developing bias electric source. Therefore, the developing sleeve 31*a* is biased to a predetermined potential against the photoreceptor belt 11. When an electromagnetic clutch configured to transmit a driving force from a motor to the developing device 30 is turned on, the attach/detach mechanism moves the developing device 30 toward the developing belt 11 due to the driving force transmitted from the motor. In a developing process, one of the developing devices moves to contact the photoreceptor belt 11. In contrast, when the electromagnetic clutch is turned off so as not to transmit the driving force, the developing device 30 moves away from the photoreceptor belt 11.

When the image forming apparatus 1 is on standby, the developing devices 30K, 30C, 30M and 30Y are set apart from the photoreceptor belt 11. When an image forming operation starts, the photoreceptor belt 11 is irradiated by a laser light based on color image data so as to form an electrostatic latent image thereon. To develop a black electrostatic latent image from the tip thereof, the developing sleeve 31*a* of the black developing device 30K rotates before the tip of the black electrostatic latent image comes into a black developing region, and the black electrostatic latent image is developed with a black toner. Such a developing operation is continued in the black developing region. When the rear end of the black electrostatic latent image passes through the black developing region, the black developing device 30K moves away from the photoreceptor belt 11. And then the developing device of the next color moves and contacts the photoreceptor belt 11 to prepare for a next developing operation, before the tip of an electrostatic latent image of the next color comes into a developing area for developing the next color image.

The intermediate transfer unit 40 includes the intermediate transfer belt 41, a belt cleaning device 42, and a position detection sensor 43. The intermediate transfer belt 41 is stretched by a driving roller 44, a primary transfer roller 45, a secondary transfer facing roller 46, a cleaning facing roller 47, and a tension roller 48, and is rotated by a driving motor (not shown). Plural position detection marks M are formed on the edge portions of the intermediate transfer belt 41 at which images are not formed. When one of these marks is detected by the position detection sensor 43, the image forming operation starts. The belt cleaning device 42 includes a cleaning brush 42*a* and an attach/detach mechanism (not shown) configured to move the cleaning device 42. While transferring each of the color toner images onto the intermediate transfer belt 41, the cleaning belt 42*a* moves away from the intermediate transfer belt 41 by the attach/detach mechanism.

The secondary transfer unit 50 includes a secondary transfer roller 51 and an attach/detach mechanism (not shown) including a clutch configured to move the secondary transfer roller 51 toward and away from the intermediate transfer belt 41. The secondary transfer roller 51 oscillates around the rotation center of the attach/detach mechanism according to a timing a transfer paper comes into a transfer region. The transfer paper is in contact with the intermediate transfer belt 41 upon application of a predetermined pressure applied by the secondary transfer roller 51 and the secondary transfer facing roller 46. The secondary transfer roller 51 is accurately arranged in parallel with the secondary transfer facing roller 46 by a position decision member (not shown) arranged on the intermediate transfer unit 40. A contact pressure between the secondary transfer roller 51 and the intermediate transfer belt 41 is maintained by a position decision roller bearing (not shown) arranged in the secondary transfer roller 51. When the secondary transfer roller 51 contacts the intermediate transfer belt 41, a transfer bias having an opposite polarity to that of the toner is applied to the secondary transfer roller 51, and then the superimposed toner image (hereinafter referred to as the toner image) is transferred onto the transfer paper.

On the other hand, when the image forming operation starts, the transfer paper is fed from a transfer paper cassette 80 or a manual feed tray 83, and stopped at a nip formed by a pair of registration rollers 82. When the tip of the toner image formed on the intermediate transfer belt 41 comes to meet the secondary transfer roller 51, the registration rollers 82 start to drive so that the tip of the transfer paper meets the tip of the toner image, resulting in position alignment of the transfer paper and the toner image. The toner image formed on the intermediate transfer belt 41 is superimposed on the transfer paper, and then the transfer paper passes a secondary transfer region. The transfer paper is charged by applying a transfer bias to the secondary transfer roller 51, and therefore almost all of the toner image is transferred onto the transfer paper. And then the transfer paper having the toner image thereon is fed to the fixing unit 60. The toner image is melted and fixed at a nip formed between a fixing belt 61 controlled to a predetermined temperature and a pressing roller 62. The transfer paper is discharged from the main body of the machine, and stacked on a discharging tray 84 face down. Thus, a full color copy is obtained.

When a duplex printing is performed, the transfer paper passed through the fixing unit 60 is fed to the duplex printing paper reversing unit 70 by a duplex printing switch pick 65. In the duplex printing paper reversing unit 70, the transfer paper is guided in a direction indicated by an arrow D by the reversing switch pick 71. After the rear end of the transfer paper passes through the reversing switch pick 71, a pair of reversing rollers 72 stops rotating to stop the transfer paper. The pair of reversing rollers 72 then starts to rotate in the reverse direction after a pause for a predetermined time, and then the transfer paper starts to switchback. At that time, the reversing switch pick 71 switches so that the transfer paper is fed to the pair of registration rollers 82. The reversed transfer paper is stopped at a nip formed between the registration rollers 82. The pair of registration rollers 82 then timely drives to feed the transfer paper to the secondary transfer region. And then the toner image is transferred onto the other side of the transfer paper from the intermediate transfer belt 41. After the toner image is melted and fixed in the fixing unit 60, the transfer paper is discharged from the main body of the machine.

On the other hand, the surface of the photoreceptor belt 11 is cleaned by the photoreceptor cleaning device 12 after the primary transfer process. The surface of the photoreceptor belt 11 may be uniformly diselectrified using a discharging lamp so as to be cleaned easily. After transferring the toner image onto the transfer paper, the surface of the intermediate transfer belt 41 is cleaned by thrusting the cleaning brush 42*a* of the belt cleaning device 42 thereto using the attach/detach mechanism. Toner particles removed from the intermediate transfer belt 41 are accumulated in a waste toner tank 49.

Next, the developing device 30 will be explained in detail. As illustrated in FIG. 1, each unit of the developing device 30 includes the developing unit 31 including the developing sleeve 31*a* configured to develop the electrostatic latent image formed on the surface of the photoreceptor belt 11 by rotating while bearing the toner, the first transport paddle 31*d* configured to transport and agitate the toner by rotating, and the toner cartridge 32 configured to contain the toner. The reason why the developing device 30 is divided is that the developing unit 31 has more durability compared to the toner cartridge 32. The developing unit 31 can be used repeatedly while the toner cartridge 32 should be replaced several times.

Figure 12:
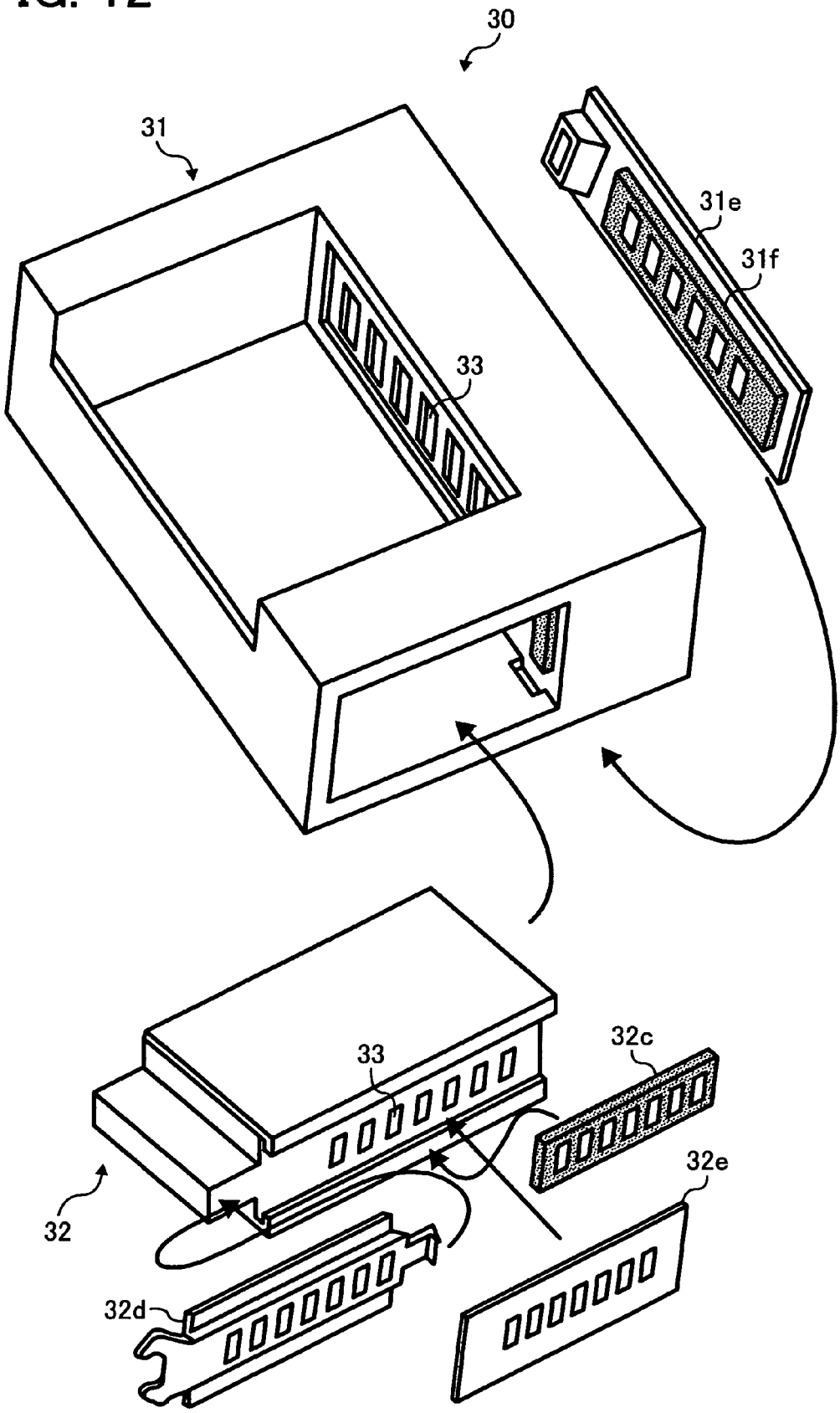
FIG. 12 is a schematic view illustrating specifics of a developing device of the present invention.

FIG. 12 is a schematic view for explaining the openings 33 arranged in the developing device 30. The housing of the developing unit 31 includes a slide shutter 31*e* outside thereof. An elastic member 31*f* is attached to the slide shutter 31*e*. The openings 33 of the developing unit 31 are opened and shut by sliding the slide shutter 31*e*. On the other hand, the toner cartridge 32 includes an elastic member 32*c* having openings corresponding to the openings 33 formed on the housing of the toner cartridge 32, a slide shutter 32*d* configured to shut (to prevent the toner from spilling out) or open (to supply the toner to the developing unit 31) the openings 33, and a fixing seal 32*e* configured to fix the toner cartridge 32 to the developing unit 31. The elastic member 32*c* is preferably made of a foam such as urethane foam, silicone foam, etc.

When the toner cartridge 32 is set in the developing device 30, by opening the slide shutter 31*e* of the developing unit 31 and the slide shutter 32*d* of the toner cartridge 32, the openings 33 are formed to pass the toner.

One or more openings 33 are formed on the developing unit 31. The slide shutter 31*e* attaching the elastic member 31*f* is arranged between the developing unit 31 and the toner cartridge 32. By sliding the slide shutter 31*e*, the openings 33 formed on the housing of the developing unit 31 can be opened or shut. When the toner cartridge 32 is not attached to the developing unit 31, or not set in the developing device 30, the toner can be prevented from spilling out from the developing unit 31 by shutting the openings 33 by sliding the slide shutter 31*e*.

In a similar way, when the toner cartridge 32 is not attached to the developing unit 31, or not set in the developing device 30, the can be prevented from toner spilling out from the toner cartridge 32 by shutting the openings by sliding the slide shutter 32*d*.

The slide shutters 31*e* and 32*d* have openings corresponding to the respective openings 33 of the developing unit 31 and the toner cartridge 32. When the openings 33 are shut, portions of the slide shutters in which the openings are not arranged cover the openings 33. In contrast, when the openings 33 are opened, portions of the slide shutters in which the windows are arranged are adjusted to the openings 33.

In the developing device 30 of the image forming apparatus 1 illustrated in FIG. 11, the first transport paddle 31*d* agitates and transports the toner to the toner supply roller 31*b*. The toner supply roller 31*b* frictionizes the toner to be charged while rubbing the developing sleeve 31*a*. The charged toner is adsorbed by the developing sleeve 31*a* due to a mirror image force, and transported to the developing region. The toner layer thickness control roller 31*c* controls the amount of the toner fed to the developing region. The electrostatic image on the photoreceptor belt 11 is developed with a toner layer formed on the developing sleeve 31*a* in the developing region due to the developing bias applied between the photoreceptor belt 11 and the developing sleeve 31*a*.

Because the toner is rubbed and pressed by the toner supply roller 31*b* and the developing sleeve 31*a*, concavities and convexities formed on the surface of the toner are smoothened, and therefore an adhesiveness of the toner increases. In addition, external additives are embedded in the surface of the toner by receiving a pressure, and therefore fluidity decreases and chargeability changes. Thereby, developability, transferability, and cleanability of the toner deteriorate.

As mentioned above, the amount of such deteriorated toner particles increases in the developing unit 31. In contrast, the amount of fresh toner particles decreases in the developing unit 31 because the fresh toner particles are used for developing. Therefore, the toner in the toner cartridge 32 is replenished to the developing unit 31 through the openings 33. In the toner cartridge 32, the second transport paddle 32*a* and the third transport paddle 32*b*, of which the tips rub the inner surface of the toner cartridge 32, are respectively arranged in the first toner storage room 321 and the second toner storage room 322. The second transport paddle 32*a* and the third transport paddle 32*b* rotate to push the toner into the developing unit 31, resulting in supplying the toner to the developing unit 31 through the openings 33.

In addition, toner particles in the developing unit 31 are returned to the toner cartridge 32 through the openings 33, and mixed with the toner in the toner cartridge 32. Since a large amount of fresh toner particles are present in the toner cartridge 32, the deteriorated toner particles in the developing unit 31 are mixed with the fresh toner particles. By mixing the fresh toner and the deteriorated toner, external additive particles present on the surface of the fresh toner particles are redistributed to the surface of the deteriorated toner particles. Thereby, chargeability and fluidity of the deteriorated toner can nearly recover to that in the initial condition. Such external additive particles are redistributed to the surface of the deteriorated toner particles while the toner is discharged from the developing unit 31 to the first toner storage room 321, and transported to the second toner storage room 322 by the second transport paddle 32*a*, and returned to the first toner storage room 321 by the third transport paddle 32*b*.

Having now fully described the invention, it will be apparent to one of ordinary skill in the art that many changes and modifications can be made thereto without departing from the spirit and scope of the invention as set forth therein.

This document claims priority and contains subject matter related to Japanese Patent Applications Nos. 2005-129551, 2005-127568, and 2005-129373, filed on Apr. 27, 2005, Apr. 26, 2005, and Apr. 27, 2005 respectively, the entire contents of each of which are hereby incorporated herein by reference.

The invention claimed is:

1. A developing device, comprising:

a developing unit configured to develop an electrostatic latent image with a toner;

a toner cartridge configured to contain the toner and supply the toner to the developing unit, and including a rotatable agitator configured to agitate the toner by rotating through the toner, wherein the toner cartridge is detachably attached to the developing unit;

at least one opening configured to pass the toner between the developing unit and the toner cartridge; and at least one control valve configured to face the at least one opening and control transport of the toner through the at least one opening by contacting with the agitator as the agitator rotates through the toner, wherein a toner replacement ratio (b/a) of the developing device satisfies relationship:

$$0.05 \leqq b/a \leqq 2.0$$

wherein a represents an amount of the toner supplied to the developing unit from the toner cartridge per a unit time and b represents an amount of the toner discharged to the toner cartridge from the developing unit per the unit time.

2. The developing device according to claim 1, wherein the toner replacement ratio (b/a) of the developing device is from 0.05 to 0.95.

3. The developing device according to claim 1, wherein the control valve forms a first space opened to the opening in the developing unit, by moving between a home position in which the opening is opened and a working position in which the opening is shut, to supply the toner in the toner cartridge to the developing unit, and wherein the agitator includes an elastic member, and the elastic member forms a second space opened to the opening in the toner cartridge, by rotating while being in contact with and released from an inner wall of the toner cartridge, to discharge the toner in the developing unit to the toner cartridge.

4. The developing device according to claim 3, wherein the control valve forms an angle against a surface of the developing unit in which the opening is arranged of from 20° to 45° at the home position, and 0° to 15° at the working position.

5. The developing device according to claim 3, wherein the toner cartridge further includes a projection arranged on an inner wall thereof, wherein the elastic member of the agitator is in contact with the projection to be bent and then released from the projection to form the second space, and wherein the agitator further includes a convex member having a fan shape in cross section arranged on a downstream side from the elastic member relative to a rotation direction of the agitator such that the projection, the convex member, and the elastic member form the second space, wherein the convex member and the elastic member form an angle of from 30° to 120°.

6. The developing device according to claim 3, wherein the control valve performs at least one shutting and opening operation while the second space is formed in the toner cartridge, and the control valve performs at least one shutting and opening operation after the second space disappears from the toner cartridge.

7. The developing device according to claim 3, wherein the developing unit further includes a rotator configured to operate the control valve, including at least two rotation members, and rotating at a rotation speed of from 0.5 to 5.0 revolutions/second, and wherein the agitator of the toner cartridge rotates at a rotation speed of from 0.04 to 0.4 revolutions/second.

8. The developing device according to claim 3, wherein a distance between a side end of the elastic member of the agitator and an inner side wall of the toner cartridge, which faces the side end of the elastic member, is not larger than 20 mm.

9. The developing device according to claim 3, comprising:

two or more openings arranged in a longitudinal direction of the toner cartridge; and two or more control valves facing the two or more openings, wherein adjoining control valves operate alternately.

10. The developing device according to claim 9, wherein a distance between the adjoining control valves is from 2 to 20 mm.

11. The developing device according to claim 9, wherein the developing unit further includes a rotator configured to operate the control valve, including at least two rotation members, and wherein the rotation members have a comb shape or a rectangular shape.

12. The developing device according to claim 3, wherein the control valve is not greater than 20 mm wider than the opening.

13. The developing device according to claim 3, wherein the control valve has a length of from 10 to 25 mm.

14. The developing device according to claim 3, comprising:

two or more openings arranged in a longitudinal direction of the toner cartridge;

two or more control valves facing the two or more openings; and an equalizer configured to equalize the toner replacement ratio (b/a) for each of the openings.

15. The developing device according to claim 14, wherein the two or more control valves serve as the equalizer and both of end valves of the two or more control valves in a longitudinal direction thereof are not less than 20% wider than other of the two or more control valves.

16. The developing device according to claim 14, wherein the equalizer includes two additional control valves arranged on an outside of each of both end valves of the two or more control valves, and wherein the two additional control valves have the same shape as the two or more control valves.

17. The developing device according to claim 14, wherein the two or more openings serve as the equalizer and have a configuration such that openings having a same shape and same number are laterally symmetrically arranged.

18. The developing device according to claim 3, comprising:

two or more openings arranged in a longitudinal direction of the toner cartridge; and two or more control valves facing the two or more openings, wherein the toner replacement ratios (b/a) for the two or more openings are different from each other.

19. The developing device according to claim 18, including at least three openings, wherein the toner replacement ratios (b/a) for a central opening of the at least three openings is less than 1, and the toner replacement ratios (b/a) for an end opening of the at least three openings is greater than 1.

20. The developing device according to claim 19, wherein the agitator of the toner cartridge further includes a platy member located on both end portions of the agitator and arranged on a downstream side from the elastic member relative to a rotation direction thereof, and wherein the elastic member and the platy member form an angle of from 30° to 120°.

21. The developing device according to claim 18, wherein the developing unit further includes a toner transport member configured to transport toner particles present outside of both end openings in a longitudinal direction to a vicinity of the openings while both end control valves in a longitudinal direction do not operate.

22. The developing device according to claim 21, wherein the toner transport member is a rotator including a platy member.

23. A developing device, comprising:

a developing unit configured to develop an electrostatic latent image with a toner;

a toner cartridge configured to contain the toner and supply the toner to the developing unit, and including a rotatable agitator configured to agitate the toner by rotating through the toner, wherein the toner cartridge is detachably attached to the developing unit;

means for passing the toner between the developing unit and the toner cartridge; and means facing the means for passing for controlling transport of the toner through the means for passing by contacting with the agitator as the agitator rotates through the toner, wherein a toner replacement ratio (b/a) of the developing device satisfies relationship:

$$0.05 \leq b/a \leq 2.0$$

wherein a represents an amount of the toner supplied to the developing unit from the toner cartridge per a unit time and b represents an amount of the toner discharged to the toner cartridge from the developing unit per the unit time.

24. An image forming apparatus. comprising:

an image bearing member configured to bear an electrostatic latent image thereon;

a charging device configured to charge the image bearing member;

a light irradiator configured to write the electrostatic latent image on the image bearing member;

a developing device configured to develop the electrostatic latent image on the image bearing member with a toner to form a toner image;

a transfer device configured to transfer the toner image onto a recording material;

a cleaning device configured to remove the toner on the image bearing member; and a fixing device configured to fix the toner image on the recording material, wherein the developing device comprises:

a developing unit configured to develop an electrostatic latent image with a toner;

a toner cartridge configured to contain the toner and supply the toner to the developing unit, and including a rotatable agitator configured to agitate the toner by rotating through the toner, wherein the toner cartridge is detachably attached to the developing unit;

at least one opening configured to pass the toner between the developing unit and the toner cartridge; and at least one control valve configured to face the at least one opening and control transport of the toner through the at least one opening by contacting with the agitator as the agitator rotates through the toner, wherein a toner replacement ratio (b/a) of the developing device satisfies relationship:

$$0.05 \leqq b/a \leqq 2.0$$

wherein a represents an amount of the toner supplied to the developing unit from the toner cartridge per a unit time and b represents an amount of the toner discharged to the toner cartridge from the developing unit per the unit time.

25. A process cartridge, comprising:

an image bearing member configured to bear an electrostatic latent image thereon; and a developing device configured to develop the electrostatic latent image on the image bearing member with a toner to form a toner image;

wherein the developing device comprises:

a developing unit configured to develop an electrostatic latent image with a toner;

a toner cartridge configured to contain the toner and supply the toner to the developing unit, and including a rotatable agitator configured to agitate the toner by rotating through the toner, wherein the toner cartridge is detachably attached to the developing unit;

at least one opening configured to pass the toner between the developing unit and the toner cartridge; and at least one control valve configured to face the at least one opening and control transport of the toner through the at least one opening by contacting with the agitator as the agitator rotates through the toner, wherein a toner replacement ratio (b/a) of the developing device satisfies relationship:

$$0.05 \leqq b/a \leqq 2.0$$

wherein a represents an amount of the toner supplied to the developing unit from the toner cartridge per a unit time and b represents an amount of the toner discharged to the toner cartridge from the developing unit per the unit time.

* * * * *